United States Patent [19]

Rudge

[11] 3,971,598

[45] July 27, 1976

[54] STRUCTURAL BEARINGS

[75] Inventor: Sydney James Rudge, Greenford, England

[73] Assignee: The Glacier Metal Company Limited, Alperton, Wembley, England

[22] Filed: Apr. 4, 1974

[21] Appl. No.: 457,892

[30] Foreign Application Priority Data

Apr. 4, 1973 United Kingdom ..... 16009/73

[52] U.S. Cl. ..... 308/3 R; 14/16.1; 248/22; 308/2 R

[51] Int. Cl.[2] ..... F16C 17/00

[58] Field of Search ..... 308/2 R, 3 R, 5 R; 14/16; 248/22

[56] References Cited

UNITED STATES PATENTS

| | | | |
|---|---|---|---|
| 3,329,472 | 7/1967 | Donnellan | 308/3 R |
| 3,397,016 | 8/1968 | Delforce | 308/3 R |
| 3,398,998 | 8/1968 | Burnett | 14/16 |

FOREIGN PATENTS OR APPLICATIONS

| | | | |
|---|---|---|---|
| 257,679 | 10/1967 | Germany | 14/16 |
| 401,596 | 1/1943 | Italy | 14/16 |
| 1,181,849 | 8/1968 | United Kingdom | 308/3 R |

*Primary Examiner*—Charles J. Myhre
*Assistant Examiner*—R. H. Lazarus
*Attorney, Agent, or Firm*—Pierce, Scheffler & Parker

[57] ABSTRACT

This invention is a bridge- or structure- bearing enabling an upper member to be supported from a base by a sliding bearing permitting universal freedom of angular movement of the upper member. A low-friction bearing surface is provided by a P.T.F.E. layer located in relation to the base by having its edges engaged in a groove machined in the base around the bearing surface.

9 Claims, 2 Drawing Figures

STRUCTURAL BEARINGS

This invention relates to structural bearings for example bearings for use in supporting components of bridges from pedestals or other bases.

According to the present invention a structural bearing comprises a base having an upwardly-facing bearing surface for supporting an upper member and a bearing layer located over the bearing surface by having its edges engaged in a groove formed in the base around the edge of the bearing surface. The layer conveniently comprises a sheet of P.T.F.E. or other plastics or other material having good wear resistance and low friction to define a good bearing surface.

Thus an upper member, for example a component of a bridge having a lower surface corresponding to that of the layer, can slide over the surface of the layer in accordance with deformations of the bridge due to changes in load and temperature, and preferably the bearing surface is the upper surface of a part-spherical depression in the base so that there is freedom of angular movement between the base and the upper member universally.

The bearing layer is prevented from moving in relation to the base by virtue of its engagement in the groove in the base and that engagement can be achieved without having to have separate clamping rings, bolts or other fixings for the bearing layer.

The invention includes a method of making such a structural bearing in which a disc of flexible sheet material for forming a bearing layer has its edges inserted in a groove around the edge of a corresponding bearing surface on a base and then the sheet is deformed through an overcentre position to conform with the bearing surface and to have the edges pushed further into the groove. The layer may be heated before being deformed and during deformation air can escape from between the base and the layer through a hole in the layer.

The invention may be carried into practice in various ways and one embodiment will be described by way of example with reference to the accompanying drawings of which:

Figure 1:
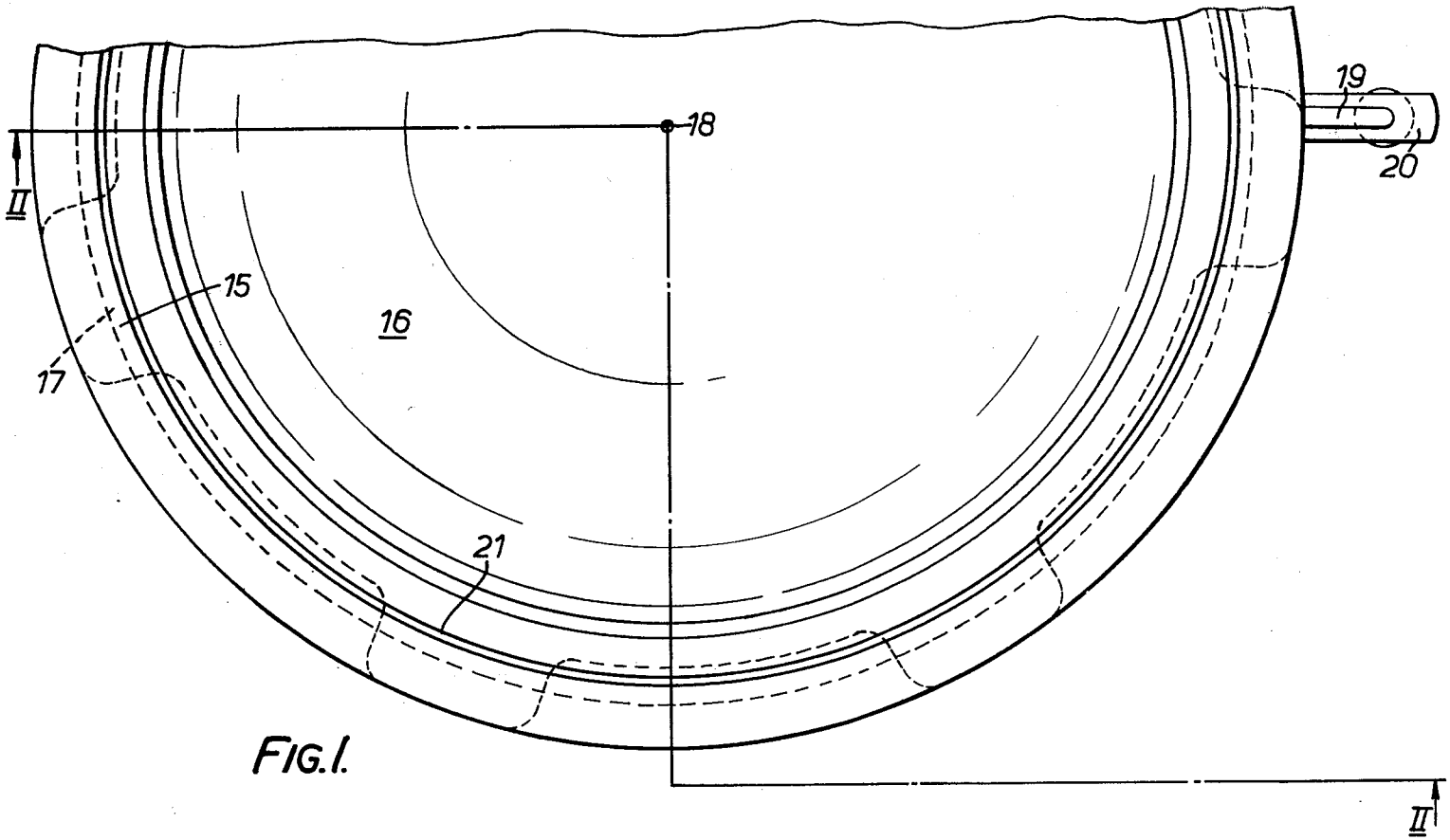
FIG. 1 is a plan view of a structural bearing embodying the invention.
Figure 2:
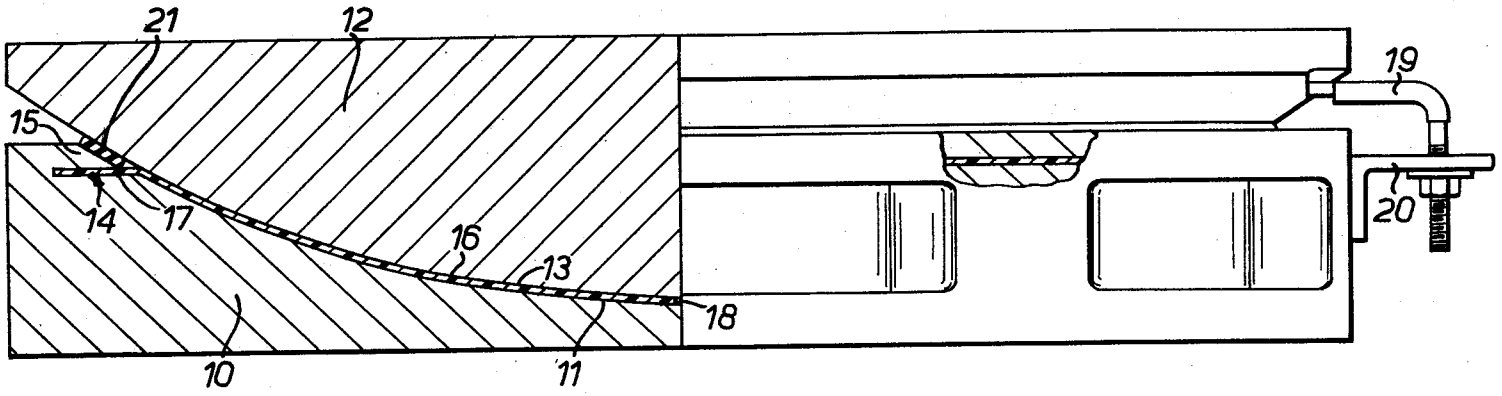
FIG. 2 is a part section on the line II - II in FIG. 1 of the structural bearing in combination with an upper member.

The bearing comprises a cast steel base 10 having in its upper surface a part-spherical depression 11 which is to be used for supporting a correspondingly shaped surface 13 of a cast steel upper member 12 which is to be secured to a downwardly facing surface on a bridge.

The bearing is designed to enable relative angular movement to take place between the base and the bridge and in order that that movement shall be against low friction losses, a bearing lining is provided for the depression 11 in the form of a circular disc-like sheet of P.T.F.E.

The layer 16 is located and held captive by having its edges 17 engaged in a groove 14 machined in a horizontal plane around the edge of the depression 11 close to the top of the base 10. The part 15 of the base 10 above the groove 14 thus acts to hold the layer 16 in position without requiring any clamping ring or other means to be fastened to the base.

A sealing ring 21 of soft resilient material is secured around the edge of the depression 11 above the groove 14 to prevent dirt getting between the bearing surface. That ring 21 can either be held in place by an adhesive or its lower edge can be turned around into the groove 14 or both expedients can be used.

During manufacture after the base has been formed with its part-spherical depression 11 the top surface of the depression, or the lower surface of the layer 16, or both, is coated with an adhesive.

The circular layer 16 is warmed to make it pliable and held over the depression 17 while its edges are inserted in the groove 14. Then the sheet is pushed through an overcentre position into contact with the depression where it is held in place by the adhesive, which also acts to assist the positive locating action of the groove. During the movement the edges of the layer may be pushed further into the groove.

A hole 18 in the centre of the layer enables air to escape from between the depression and the layer as the layer is pushed into position.

The assembly of base 11, upper member 12 and layer 16, is despatched from the factory to the site where it is to be used, and clamps 19 and 20 are used to hold the members from relative movement during transit and until the bearing is in position and ready to be used.

What I claim as my invention and desire to secure by Letters Patent is:

1. A structure bearing comprising (1) an upper member, (2) a base member having a part sherical upwardly facing bearing surface supporting said upper member, there being a groove formed in said base member near the top and extending from said part spherical bearing surface substantially horizontally into said base member, and (3) a bearing layer supported on said bearing surface and fixed in position by having its edges engaged in said groove, said bearing layer engaging the upper member in such a manner as to permit universal freedom of angular movement of said upper member relative to the base member.

2. A structure bearing as claimed in claim 1 in which the bearing layer comprises a sheet of Poly-tetra-fluoro-ethylene.

3. A structure bearing as claimed in claim 1 including a dirt-preventing sealing ring around the edge of the bearing layer.

4. A structure bearing as claimed in claim 1 in which the layer has a hole for the escape of air from between the base and the layer as the layer is put into position.

5. A structure bearing as claimed in claim 2 in which there is an adhesive between the layer and the base.

6. A structure bearing as claimed in claim 3 in combination with an upper member having a lower surface corresponding to that of the layer and capable of movement with respect to the layer.

7. A structure bearing as claimed in claim 6 including clamping means temporarily holding the base and the upper member against relative movement.

8. A structure bearing as claimed in claim 1, in which the layer is deformed through an overcenter position to conform with the bearing surface.

9. A structure bearing as claimed in claim 8, in which the layer has been heated before being deformed.

* * * * *